US009752416B2

(12) United States Patent
Anderson et al.

(10) Patent No.: US 9,752,416 B2
(45) Date of Patent: Sep. 5, 2017

(54) METHOD OF PREVENTING HYDRATE FORMATION IN OPEN WATER CAPTURE DEVICES

(71) Applicant: SHELL OIL COMPANY, Houston, TX (US)

(72) Inventors: Karl Gregory Anderson, Missouri City, TX (US); Gaurav Bhatnagar, Houston, TX (US); Sujatha Degaleesan, Katy, TX (US); Gregory John Hatton, Houston, TX (US)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 15/110,794

(22) PCT Filed: Jan. 8, 2015

(86) PCT No.: PCT/US2015/010590
§ 371 (c)(1),
(2) Date: Jul. 11, 2016

(87) PCT Pub. No.: WO2015/105952
PCT Pub. Date: Jul. 16, 2015

(65) Prior Publication Data

US 2016/0333674 A1 Nov. 17, 2016

Related U.S. Application Data

(60) Provisional application No. 61/926,733, filed on Jan. 13, 2014.

(51) Int. Cl.

| | |
|---|---|
| ***E02B 15/04*** | (2006.01) |
| ***E21B 43/01*** | (2006.01) |
| ***E02B 15/08*** | (2006.01) |
| *E02B 15/00* | (2006.01) |

(52) U.S. Cl.
CPC ..... *E21B 43/0122* (2013.01); *E02B 15/04* (2013.01); *E02B 15/08* (2013.01); *E02B 15/0814* (2013.01); *E02B 2015/005* (2013.01)

(58) Field of Classification Search
CPC ..... E21B 43/0122; E02B 2015/005; E02B 15/00; E02B 15/04
See application file for complete search history.

(56) References Cited

U.S. PATENT DOCUMENTS 4,283,159 A * 8/1981 Johnson ..... E21B 43/0122 166/364
4,318,442 A * 3/1982 Lunde ..... E21B 43/36 166/357
4,323,118 A * 4/1982 Bergmann ..... E21B 33/02 166/356
4,358,218 A * 11/1982 Graham ..... E21B 43/0122 210/922

(Continued)

FOREIGN PATENT DOCUMENTS

FR WO 2014037141 A2 * 3/2014 ..... E21B 43/0122
FR WO 2014037569 A2 * 3/2014 ..... E21B 43/0122

(Continued)

*Primary Examiner* — Frederick L Lagman

(57) ABSTRACT

An open water capture device comprising a structure, wherein the structure comprises an open bottom, a top, and one or more injection primary ports.

10 Claims, 3 Drawing Sheets

(56) References Cited

U.S. PATENT DOCUMENTS 4,416,565 A * 11/1983 Ostlund ..... E21B 43/0122 210/170.11
4,531,860 A * 7/1985 Barnett ..... E21B 43/0122 210/923
5,191,940 A * 3/1993 Alonso ..... B01D 19/0042 166/79.1
8,444,344 B2 * 5/2013 Oesterberg ..... E21B 43/0122 166/364
2011/0005452 A1 1/2011 Baylot et al.
2011/0274493 A1 * 11/2011 Cutts ..... E21B 43/0122 405/60
2011/0315396 A1 * 12/2011 Wolinsky ..... E21B 43/0122 166/363
2012/0027517 A1 * 2/2012 Shifferaw ..... E21B 43/0122 405/60
2012/0051840 A1 3/2012 Hatton
2012/0051841 A1 3/2012 Hatton et al.
2012/0087729 A1 4/2012 Oesterberg et al.
2012/0125623 A1 * 5/2012 Cargol, Jr. ..... E21B 43/0122 166/344
2012/0155964 A1 6/2012 Carter et al.
2012/0213587 A1 8/2012 Le Bas et al.
2012/0328373 A1 * 12/2012 Bond ..... E21B 43/0122 405/210
2013/0118754 A1 * 5/2013 Worrall ..... E21B 37/06 166/344
2013/0140036 A1 * 6/2013 Freund ..... E21B 43/0122 166/363
2013/0206421 A1 * 8/2013 De Ghetto ..... E21B 43/36 166/357

FOREIGN PATENT DOCUMENTS

GB 2055414 A * 3/1981 ..... E21B 33/02
GB 2063776 A * 6/1981 ..... E21B 43/0122
WO 2011154733 12/2011

* cited by examiner

METHOD OF PREVENTING HYDRATE FORMATION IN OPEN WATER CAPTURE DEVICES

CROSS REFERENCE TO RELATED APPLICATIONS

The present application is a National Stage (§371) of International Application No. PCT/US2015/010590, filed Jan. 8, 2015, which claims priority from U.S. Provisional Application No. 61/926,733, filed Jan. 13, 2014, the disclosures of each of which are hereby incorporated by reference in their entirety.

BACKGROUND

The present disclosure relates generally to open water capture devices. More specifically, in certain embodiments the present disclosure relates to methods of preventing hydrate formation in open water capture devices.

When oil and gas are spilled into the sea, for example from a leaking pipelines, seepage from underground formations, or from oil flowing from a subsea wellhead or blowout preventer, there is a desire to collect the oil and gas and contain and transport or otherwise dispose of the oil and gas to prevent environmental damage to the sea and nearby coastlines. Conventional methods and devices useful for collecting oil and gas from are described in U.S. Patent Application Publication Nos. 2012/0051841, 2012/0051840, and 2012/0213587, the entireties of which are hereby incorporated by reference.

Such methods typically may involve placing an open water capture device over the leak. However, conventional methods of collecting oil and gas may suffer from several deficiencies. First, along with the leaked oil, these capture devices may capture a large volume of sea water making containment of the oil more difficult. Second, these capture devices may be prone to being blocked by hydrates. Hydrates may form rapidly in stagnant water in bound open water capture devices. Very little time may be required for enough gas to dissolve in the stagnant water to move the capture device environment into the hydrate region.

It is desirable to provide an open water capture device that restricts the volume of sea water capture with the hydrocarbon and avoids blockage due to hydrate formed by the hydrocarbons and the sea.

SUMMARY

The present disclosure relates generally to open water capture devices. More specifically, in certain embodiments the present disclosure relates to methods of preventing hydrate formation in open water capture devices.

In one embodiment, the present disclosure provides an open water capture device comprising a structure, wherein the structure comprises an open bottom, a top, and one or more primary injection ports.

In another embodiment, the present disclosure provides an open water containment system comprising: an open water capture device, wherein the open water capture device comprises: a structure, wherein the structure comprises an open bottom, a top, and one or more primary injection ports and a flow line attached to the top of the structure and a leak source, wherein the open water capture device is located above the leak source.

In another embodiment, the present disclosure provides a method of limiting the formation of gas hydrates in an open water capture device comprising: providing an open water capture device, wherein the open water capture device comprises: a structure, wherein the structure comprises an open bottom, a top, and one or more primary injection ports and a flow line attached to the top of the structure; positioning the open water capture device over a leak source; allowing fluid from the leak source to flow into the open water capture device; and injecting fluid into the open water capture device.

BRIEF DESCRIPTION OF THE DRAWINGS

So that the above recited features and advantages of the disclosure may be understood in detail, a more particular description of the disclosure, briefly summarized above, may be had by reference to the embodiments thereof that are illustrated in the appended drawings. It is to be noted, however, that the appended drawings illustrate only typical embodiments of this disclosure and are, therefore, not to be considered limiting of its scope. The figures are not necessarily to scale, and certain features and certain views of the figures may be shown exaggerated in scale or in schematic in the interest of clarity and conciseness.

The features and advantages of the present disclosure will be readily apparent to those skilled in the art. While numerous changes may be made by those skilled in the art, such changes are within the spirit of the disclosure.

DETAILED DESCRIPTION

The description that follows includes exemplary apparatuses, methods, techniques, and/or instruction sequences that embody techniques of the inventive subject matter. However, it is understood that the described embodiments may be practiced without these specific details.

The present disclosure relates generally to open water capture devices. More specifically, in certain embodiments the present disclosure relates to methods of preventing hydrate formation in open water capture devices In certain embodiments, the present disclosure provides a method for preventing the hydrate plugging of an open water capture device. The formation of hydrates may be prevented by continually flushing the capture device with nearby water, or other fluids, that has a low concentration of dissolved hydrate forming gases. If this is done effectively, then the concentration of dissolved hydrate forming gases may be maintained below the level required to enter the hydrate region and form stable hydrates.

Figure 1:
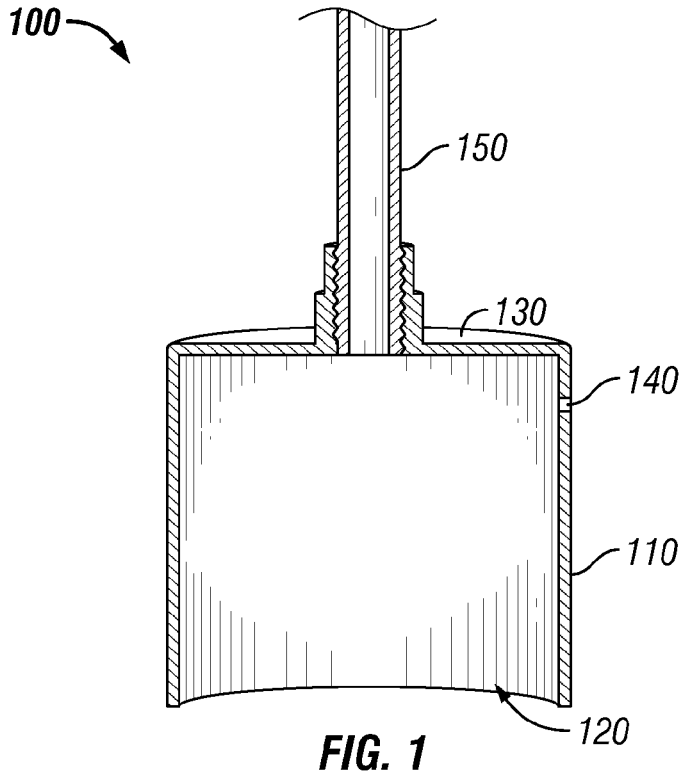
FIG. 1 is an illustration of an open water capture device in accordance with certain embodiments of the present disclosure.

Referring now to FIG. 1, FIG. 1 illustrates an open water capture device 100 in accordance with certain embodiments of the present disclosure. In certain embodiments, open water capture device 100 may comprise structure 110 with open bottom 120, top 130, and one or more primary injection ports 140.

In certain embodiments, structure 110 may have a dome or funnel shape. Structure 110 may be constructed out of any material suitable for in a deepwater environment. Examples of suitable materials include steel.

In certain embodiments, open bottom 120 of structure 110 may be open to the water. In certain embodiments, top 130 of structure 110 may be connected to a riser 150.

In certain embodiments, primary injection ports 140 may be disposed on structure 110. In certain embodiments, primary injection ports 140 may be disposed on structure 110 such that they induce circulation within structure 110 about structure 110's vertical axis when fluid is injected into structure 110. In certain embodiments, structure 110 may comprise one, two, three, four, or more primary injection ports 140. In certain embodiments, primary injection ports 140 may be disposed on structure 110 such that they allow for introduction of fluid into structure 110 into or above a water pad. In other embodiments, primary injection ports 140 may be disposed on structure 110 such that they allow for the introduction of fluid into structure 110 above a leak source. In certain embodiments, the fluid may be hydrocarbons from the leak source. In other embodiments, the fluid may be sea water. In certain embodiment, the fluid injected into the open water capture device may be heated fluid.

Figure 2:
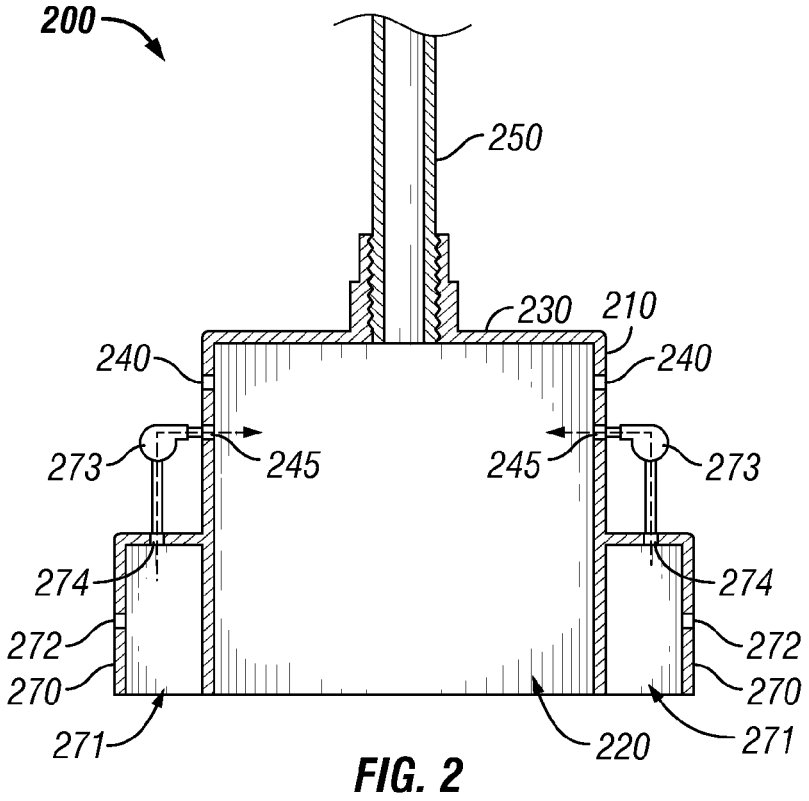
FIG. 2 is an illustration of an open water capture device in accordance with certain embodiments of the present disclosure.

Referring now to FIG. 2, FIG. 2 illustrates an open water capture device 200 in accordance with certain embodiments of the present disclosure. Open water capture device 200 may include the same features as open water capture device 100 illustrated in FIG. 1, such as structure 210 with open bottom 220, top 230, primary injection ports 240, and riser 250. Open water capture device 200 may further comprise one or more secondary chambers 270.

In certain embodiments, secondary chamber 270 may include an open bottom 271, one or more secondary injection ports 272, pump 273, and outlet 274. In certain embodiments, secondary chamber 270 may completely surround a bottom portion of structure 210. In certain embodiments, open bottom 271 of secondary chamber 270 may be above or below open bottom 220 of structure 210.

Secondary chamber 270 may be constructed out of any material suitable for in a deepwater environment. Examples of suitable materials include steel. In certain embodiments, open bottom 271 of secondary chamber 270 may be open to the water. In certain embodiments, open bottom 271 of secondary chamber 270 may be located above or below open bottom 220 of structure 210 in a manner such that the under flow of structure 210 may flow into secondary chamber 270. In certain embodiments, secondary injection ports 272 may be disposed on secondary chamber 270 in addition with having primary injection ports 240 disposed on structure 210. In other embodiments, secondary injection ports 272 may be disposed on secondary chamber 270 without having any primary injection ports 240 disposed on structure 210. In certain embodiments, secondary injection ports 272 may be disposed on secondary chamber 270 such that they induce circulation within secondary chamber 270 about secondary chamber 270's vertical axis when fluid is injected into secondary chamber 270.

In certain embodiments, pump 273 may pump fluid from secondary chamber 270 through one or more outlets 274 and into structure 210 via tertiary injection ports 245. In other embodiments where structure 210 does not comprise any tertiary injection ports, not illustrated, pump 273 may pump fluid from secondary chamber 270 through one or more outlets 274 and into structure 210 via primary injection ports 240. In certain embodiments, the fluid pumped from secondary chamber 270 may be a hydrocarbon-rich stream while the underflow from secondary chamber 270 may be a hydrocarbon-depleted stream. In certain embodiments, tertiary injection ports 245 may be disposed on structure 210 such that they allow for introduction of fluid into structure 210 into or above a water pad. In certain embodiments, tertiary injection ports 245 may be disposed on structure 210 such that they induce circulation within structure 210 about structure 210's vertical axis when fluid is injected into structure 210.

Figure 3:
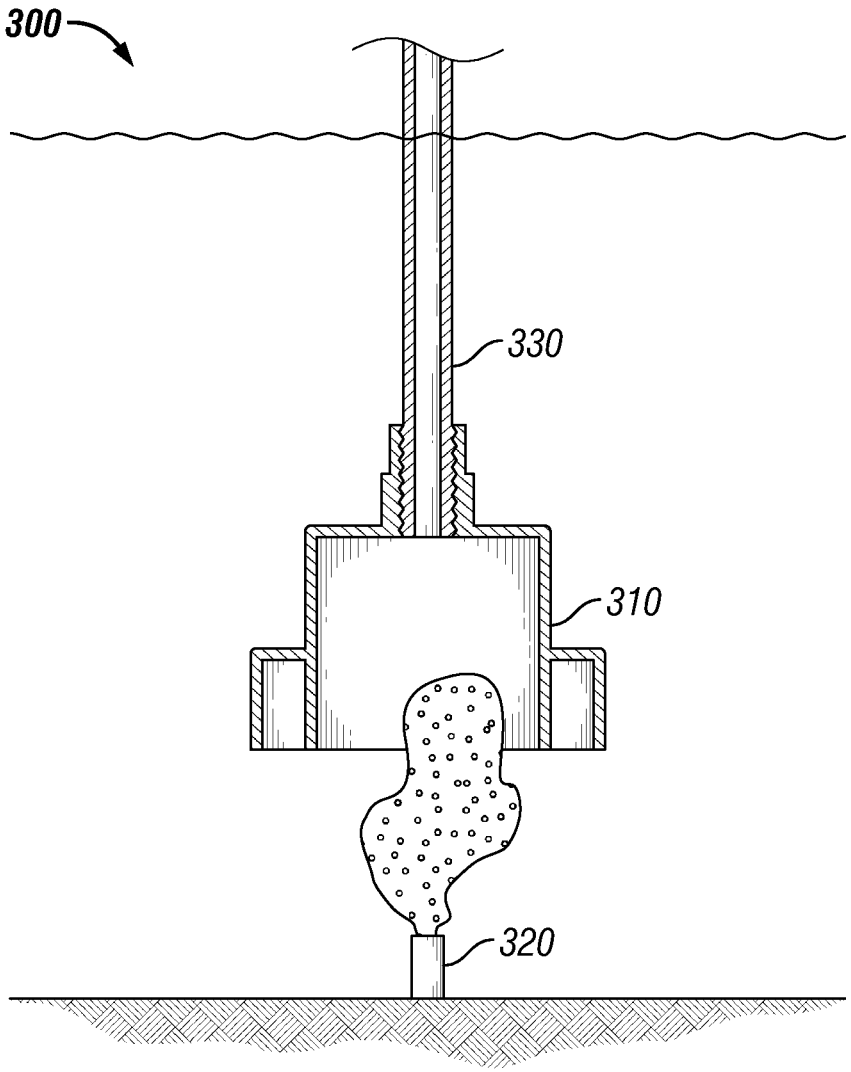
FIG. 3 is an illustration of an open water containment system in accordance with certain embodiments of the present disclosure.

Referring now to FIG. 3, FIG. 3 illustrates an open water containment system 300. Open water containment system 300 may comprise an open water capture device 310, a leak source 320, and a flow line 330.

In certain embodiments, open water capture device 310 may include any of the features described above with respect to open water capture device 100 and open water capture device 200.

In certain embodiments, the leak source 320 may comprise a leak from the sea floor or a leak from a piece of subsea equipment. In certain embodiments, hydrocarbon may flow into the open water capture device 310 from the leak source 320. Hydrocarbons may be transported to the surface via flow line 330.

In certain embodiments, the present disclosure provides a method comprising: providing an open water capture device; positioning the open water capture device above a leak source; allowing hydrocarbons from the leak source to flow into an open bottom of the open water capture device; and injecting fluid into the open water capture device.

In certain embodiments, the open water capture device can be positioned above the subsea link by lowering the open water capture device directly above the subsea leak. In other embodiments, the open water capture device may be lowered vertically next to the subsea leak and then move horizontal to be positioned above the subsea leak. Once the open water capture device is positioned above the subsea leak it may be further lowered. In certain embodiments, the open water capture device can be lowered over the subsea leak such that the bottom of open water capture device is at a depth below than the subsea leak.

In certain embodiments, hydrocarbons from the subsea leak may be allowed to flow in to the open bottom of open water capture device through natural convection. In certain embodiments, fluid may be injected into the open water capture device through a primary, secondary, and/or tertiary injection port. In certain embodiments, the injected fluid may prevent the formation of hydrates in the open water capture device by lowering the concentration of hydrate forming gas in the open water capture device to a concentration below the level required to enter the hydrate region and form stable hydrates.

In embodiments the open water capture device comprises one or more secondary chambers, fluid may be injected into the one or more secondary chambers to displace the fluid present in the secondary chambers and then the displaced fluid may pumped from the one or more secondary chambers into the open water capture device via the outlets. In certain embodiments, fluids displaced out the bottom of the open water capture device may flow into the one or more secondary chambers by natural convection.

In certain embodiments, water injected into the open water capture device may displaces water and dissolved hydrate forming gases already present in the open water capture device and flush that water with dissolved hydrate forming gases out of the bottom of the open water capture device. In certain embodiments, the one or more secondary chambers provide more residence time for separation and allow a considerably less flow rate into the open water capture device while still keep the open water capture device out of the hydrate forming region.

In certain embodiments, a liquid bather may be added to the open water capture device, before, during, or after installation.

Figure 4:
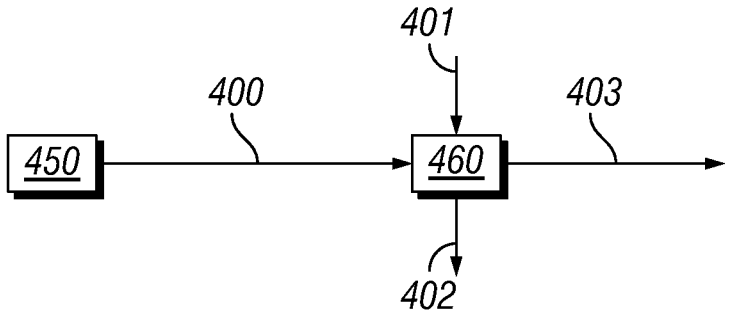
FIG. 4 is a process flow diagram in accordance with certain embodiments of the present disclosure.

Referring now to FIG. 4, FIG. 4 illustrates a process flow diagram in accordance with certain embodiments of the present disclosure. Hydrocarbon stream 400 from subsea leak 450 may flow by natural convection into open water capture device 460. A fluid stream 401 may be injected into open water capture device 460 and displace a hydrocarbon lean stream 402 from the bottom of the open water capture device and a hydrocarbon rich stream 403 from the top of the open water capture device 460.

Figure 5:
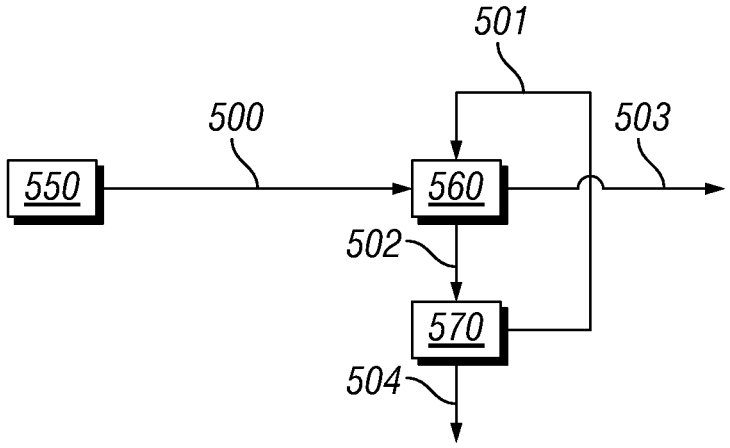
FIG. 5 is a process flow diagram in accordance with certain embodiments of the present disclosure.

Referring now to FIG. 5, FIG. 5 illustrates a process flow diagram in accordance with certain embodiments of the present disclosure. Hydrocarbon stream 500 from subsea leak 550 may flow by natural convection into open water capture device 560. Fluid stream 501 from secondary chamber 570 may be injected into open water capture device 560 and displace a hydrocarbon lean stream 502 from the bottom of the open water capture device 560 and a hydrocarbon rich stream 503 from the top of the open water capture device 560. Displaced hydrocarbon lean stream 502 may flow into secondary chamber 570 while hydrocarbon rich stream 503 may then exit open water capture device 560. A second displaced hydrocarbon stream 504 may flow from the bottom of the secondary chamber 570.

While the embodiments are described with reference to various implementations and exploitations, it will be understood that these embodiments are illustrative and that the scope of the inventive subject matter is not limited to them. Many variations, modifications, additions and improvements are possible. For example, one or more chemical and/or mechanical techniques as described herein may be used to heat the wellbore.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

The invention claimed is:

1. An open water capture device comprising:

a structure, wherein the structure comprises an open bottom, a top, and one or more primary injection ports;

a secondary chamber, wherein the secondary chamber comprise an open bottom, one or more secondary injection ports, one or more pumps, and one or more outlets, wherein the one or more outlets of the secondary chamber are in fluid communication with the primary injection ports and wherein the one or more pumps are capable of pumping fluid from the secondary chamber through the one or more outlets into the structure via the one or more primary injection ports.

2. The open water capture device of claim 1, wherein the one or more primary injection ports are disposed on the structure such that they are capable of inducing circulation within the structure when fluid is injected into the structure.

3. The open water capture device of claim 1, wherein the structure comprises one or more tertiary injection ports.

4. The open water capture device of claim 3, wherein the one or more outlets of the secondary chamber are in fluid communication with the one or more tertiary injection ports.

5. An open water containment system comprising:

an open water capture device, wherein the open water capture device comprises:

a structure, wherein the structure comprises an open bottom, a top, and one or more primary injection ports and a secondary chamber, wherein the secondary chamber comprise an open bottom, one or more secondary injection ports, one or more pumps, and one or more outlets, wherein the one or more outlets of the secondary chamber are in fluid communication with the primary injection ports and wherein the one or more pumps are capable of pumping fluid from the secondary chamber through the one or more outlets into the structure via the one or more primary injection ports;

a flow line attached to the top of the structure; and a leak source, wherein the open water capture device is located above the leak source.

6. The open water containment system of claim 5, wherein the flow line is a riser.

7. The open water containment system of claim 5, wherein the leak source is a leak from the sea floor or a leak from a piece of subsea equipment.

8. A method of limiting the formation of gas hydrates in an open water capture device comprising:

providing an open water capture device, wherein the open water capture device comprises:

a structure, wherein the structure comprises an open bottom, a top, one or more primary injection ports, and one or more tertiary injection ports and a secondary chamber, wherein the secondary chamber comprise an open bottom, one or more secondary injection ports, one or more pumps, and one or more outlets, wherein the one or more outlets of the secondary chamber are in fluid communication with the primary injection ports and wherein the one or more pumps are capable of pumping fluid from the secondary chamber through the one or more outlets into the structure via the one or more primary injection ports;

positioning the open water capture device over the leak source;

allowing fluid from the leak source to flow into the open water capture device;

and injecting fluid into the open water capture device through the one or more tertiary injection ports.

9. The method of claim 8, wherein the fluid injected into the open water capture device comprises water and/or hydrocarbons.

10. The method of claim 8, wherein the fluid injected into the open water capture device lowers the concentration of hydrate forming gas in the open water capture device.

* * * * *